US008979054B2

(12) United States Patent
Thompson

(10) Patent No.: US 8,979,054 B2
(45) Date of Patent: Mar. 17, 2015

(54) WALL MOUNTABLE STORAGE ASSEMBLY WITH ARTICULATING CONNECTION

(71) Applicant: 3M Innovative Properties Company, St. Paul, MN (US)

(72) Inventor: Craig D. Thompson, Inver Grove Heights, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 204 days.

(21) Appl. No.: 13/717,340

(22) Filed: Dec. 17, 2012

(65) Prior Publication Data

US 2014/0166829 A1 Jun. 19, 2014

(51) Int. Cl.

| | |
|---|---|
| ***A47G 1/17*** | (2006.01) |
| ***A47K 3/28*** | (2006.01) |
| ***A47K 5/02*** | (2006.01) |

(52) U.S. Cl.

CPC . *A47K 3/281* (2013.01); *A47K 5/02* (2013.01); *A47K 2201/025* (2013.01)

USPC ..... 248/241; 248/220.21

(58) Field of Classification Search

USPC ..... 248/201, 205.1, 205.3, 220.21, 220.22, 248/235, 241, 243, 244, 250; 211/88.01, 211/88.03

See application file for complete search history.

(56) References Cited

U.S. PATENT DOCUMENTS

| | | | | |
|---|---|---|---|---|
| 5,090,652 | A | 2/1992 | Cattaneo | |
| 5,507,464 | A | 4/1996 | Hamerski et al. | |
| 6,131,864 | A | 10/2000 | Schumann | |
| 6,245,177 | B1 | 6/2001 | Lühmann | |
| 6,279,210 | B1 | 8/2001 | Faass | |
| D577,913 | S | 10/2008 | Thompson et al. | |
| 7,540,456 | B2 * | 6/2009 | Thompson | 248/205.3 |
| 7,802,766 | B2 | 9/2010 | Thompson | |
| 8,020,820 | B2 * | 9/2011 | Thompson | 248/220.1 |
| 8,814,112 | B2 * | 8/2014 | Thompson | 248/205.3 |
| 2007/0102601 | A1 | 5/2007 | Thompson | |
| 2007/0257165 | A1 * | 11/2007 | Newbould et al. | 248/205.3 |

(Continued)

FOREIGN PATENT DOCUMENTS

| | | |
|---|---|---|
| JP | 2004-057456 | 2/2004 |

OTHER PUBLICATIONS

International Search Report for PCT/US2013/073715, dated Dec. 6, 2013, prepared by the Korean Intellectual Property Office.

*Primary Examiner* — Steven Marsh

(74) *Attorney, Agent, or Firm* — Sandra K. Nowak

(57) ABSTRACT

A wall mountable storage assembly including a storage device, at least one mounting plate, and at least one double-faced adhesive. The storage device includes a coupling bracket forming a first engagement feature. The mounting plate forms a second engagement feature. The first and second engagement features have a complimentary construction configured to provide a releasable snap fit connection in which the mounting plate can articulate relative to the coupling bracket. The adhesive is configured to be arranged between the mounting plate and a wall, with the mounting plate articulating relative to the coupling bracket to facilitate complete contact between the adhesive and the wall. The storage device can include two spaced-apart coupling brackets. Two of the mounting plates are provided, each carrying adhesive. The mounting plates can articulate independent of one another, accommodating variations in flatness of the wall to which the storage assembly is mounted.

19 Claims, 11 Drawing Sheets

(56) References Cited

U.S. PATENT DOCUMENTS

| | | | |
|---|---|---|---|
| 2008/0053931 | A1 | 3/2008 | Newbould et al. |
| 2008/0053932 | A1 | 3/2008 | Newbould et al. |
| 2008/0053935 | A1 | 3/2008 | Newbould et al. |
| 2009/0242712 | A1 | 10/2009 | Thompson |
| 2009/0294034 | A1 | 12/2009 | Thompson |
| 2010/0308186 | A1 | 12/2010 | Thompson |
| 2012/0032043 | A1 | 2/2012 | McGreevy et al. |
| 2012/0153102 | A1 | 6/2012 | Thompson |

* cited by examiner

WALL MOUNTABLE STORAGE ASSEMBLY WITH ARTICULATING CONNECTION

BACKGROUND

The present disclosure relates to storage devices (e.g., caddies, shelves, etc.) that can be adhesively mounted to a wall. More particularly, it relates to wall mountable storage devices useful to hold a variety of items and adhesively mounted to various wall surfaces, including uneven and/or non-flat wall surfaces, such as a bath or shower enclosure wall.

Adhesives (e.g., pressure sensitive adhesives) have often found use in attaching articles to surfaces. For example, double-faced adhesive strips (i.e., strips bearing adhesive on both opposing major surfaces) are widely known and used. In particular, stretch-releasing adhesive strips and tapes have found use in a wide variety of assembly, joining, attaching, and mounting applications.

One such exemplary use of double-faced adhesives is to hold or mount a storage device (e.g., shelves, containers, baskets, caddies, etc.) to a wall. For example, shower and bath storage devices, often referred to as a shower or bath caddy, are commonly used to hold and/or store items such as soap, shampoo, and other bath items in shower and bath enclosures. Because of the weight of the stored items and because it is generally not practical to mount such items to the shower or bath enclosure wall using mechanical fasteners (e.g., nails or screws), such devices are typically hung from the shower nozzle fixture. Other techniques include mounting the storage device to the shower or bath wall with suction cups; however, suction cups have limited holding capacity and tend to lose their holding ability over time. To address these problems, shower caddies and other storage or organizing devices have been devised that utilize stretch-releasable adhesive tapes to secure the storage device to the shower wall. For example, 3M Command Shower Caddy™ products available from 3M Company of St. Paul, Minn. are available and have been well received.

A variety of mounting plate or backplate constructions have been developed that facilitate secure connection between the storage device and the double-faced adhesive (and thus the wall to which the storage device is mounted). In general terms, the mounting plate serves as an intermediate structure that mechanically connects the storage device with the double-faced adhesive. The mounting plate provides a bracket or other mounting fixture along one side, and is directly attached to the adhesive along the opposite side. The storage device, in turn, carries a complimentary bracket or fixture configured to releasably engage the mounting plate's bracket, preferably in a snap fit engagement. Mounting of the storage device to a wall surface includes the mounting plate attached to the storage device, a first side of the adhesive secured to the mounting plate, and a second side of the adhesive connected to the wall surface. When removal of the entire assembly from the wall is desired, the storage device is first disconnected from the mounting plate. Once the storage device is removed, the mounting plate/adhesive can easily be accessed and released from the wall surface (e.g., stretch-releasing the adhesive). Similar designs and mounting techniques are commonly employed for other wall mountable storage devices that are not necessarily intended to be used in a shower or bath environment.

In many instances, the storage device in question is relatively long (e.g., 6 inches or more) and is intended to be maintained in a horizontal orientation. Under these circumstances, one or more individual strips of the double-faced adhesive are applied at or adjacent opposite ends of the storage device (via the mounting plates described above) to provide robust support upon mounting to a wall surface. Where the elongated storage device is mounted to a flat wall surface by two spaced apart mounting plates/adhesives, the above-described formats are highly efficient. As a point of reference, it is desirable to provide a rigid, snap fit connection between the mounting plates and the storage device. While this construction is highly beneficial in establishing necessary support of the storage device relative to the wall surface, variations in flatness of the wall surface can prevent complete contact (or "wetting") between the adhesive and the wall surface from occurring. A typical mounting technique first entails connecting the two (or more) mounting plates to the storage device (such that the two mounting plates are spaced from one another), and then exposing an adhesive face of the double-faced adhesive carried by each the mounting plates. The exposed adhesives are then brought into contact with the wall surface typically by directing the storage device toward the wall surface. Where the wall surface is not flat across the spacing distance between the two mounting plates, one or both of the exposed adhesive faces may not come into complete contact with the wall surface. This concern is more prevalent in certain end-use environments such as shower and bath enclosures (e.g., a tiled bath wall surface is inherently uneven from tile-to-tile, fiberglass shower walls typically have a slight curvature, etc.).

In light of the above, a need exists for a storage device that can be adhesively mounted to a wall surface of a shower or bath enclosure (or other potentially uneven or non-flat wall surface) in a manner promoting thorough contact between spaced apart exposed adhesive surfaces and the uneven or non-flat wall.

SUMMARY

Some aspects of the present disclosure relate to a wall mountable storage assembly. The storage assembly includes a storage device, at least one mounting plate, and at least one double-faced adhesive. The storage device includes a main body and at least one coupling bracket. The main body can have a variety of forms (e.g., caddy, shelf, etc.). The coupling bracket is attached to the main body and forms a first engagement feature. The mounting plate forms a bonding face and a second engagement feature. The bonding face is adapted to receive the double-faced adhesive and the second engagement feature is formed opposite the bonding face. The first and second engagement features have a complimentary construction configured to provide a releasable snap fit connection of the mounting plate with the coupling bracket. In this regard, the snap fit connection includes the mounting plate being articulatable relative to the coupling bracket. The double-faced adhesive is configured to be arranged between the bonding face and a wall for securing the storage assembly to the wall. With this construction, the storage assembly can be mounted to a wall surface, with the mounting plate articulating relative to the coupling bracket (and thus relative to the storage device) to facilitate complete contact between the adhesive and the wall, while retaining the snap fit connection. In some embodiments, the coupling bracket provides a cross-bar as the first engagement feature, whereas the mounting plate includes a finger serving as the second engagement feature. The cross-bar forms a curved (e.g., convex curve) shape about which a substantially flat surface of the mounting plate can articulate. In related embodiments, the finger forms a tent-like or tapering shape about which a substantially flat surface of the coupling bracket can articulate and/or presents minimal interference to the mounting plate articulating along the cross-bar curved shape. With embodiments in which the storage device has an elongated length and is formatted to be mounted such that the length is substantially horizontal, the first and second engagement features are configured such that articulation of the mounting plate relative to the storage device includes the mounting plate effectively pivoting about an axis that is substantially vertical. In yet other embodiments, the storage device includes two of the coupling brackets, with the coupling brackets being longitudinally spaced from one another. Two of the mounting plates are also provided, with each mounting plate carrying, or adapted to carry, a piece or strip of the double-faced adhesive. With these constructions, when the mounting plates are engaged with a corresponding one of the coupling brackets in the releasable snap fit connection, the mounting plates can articulate relative to the storage device independent of one another, thereby accommodating variations in flatness of the wall surface to which the storage assembly is mounted.

Other aspects in accordance with principles of the present disclosure relate to a method of mounting a storage device to a wall. A storage device is received, with the storage device including a main body, and first and second coupling brackets. The coupling brackets are longitudinally spaced from one another, and each includes a first engagement feature. A second engagement feature of a first mounting plate is snap fitted to the first engagement feature of the first coupling bracket, and a second engagement feature of a second mounting plate is snap fitted to the first engagement feature of the second coupling bracket. An adhesive surface of a double-faced adhesive carried by each of the mounting plates is exposed. The storage device is moved toward the wall such that the exposed adhesive surfaces initially contact the wall. At least one of the mounting plates is articulated relative to the main body such that the exposed adhesive surfaces fully contact and bond to the wall. In this regard, the mounting plates retain the snap fit connection to the corresponding coupling bracket with articulation of the mounting plate relative to the main body.

DETAILED DESCRIPTION

Figure 1:
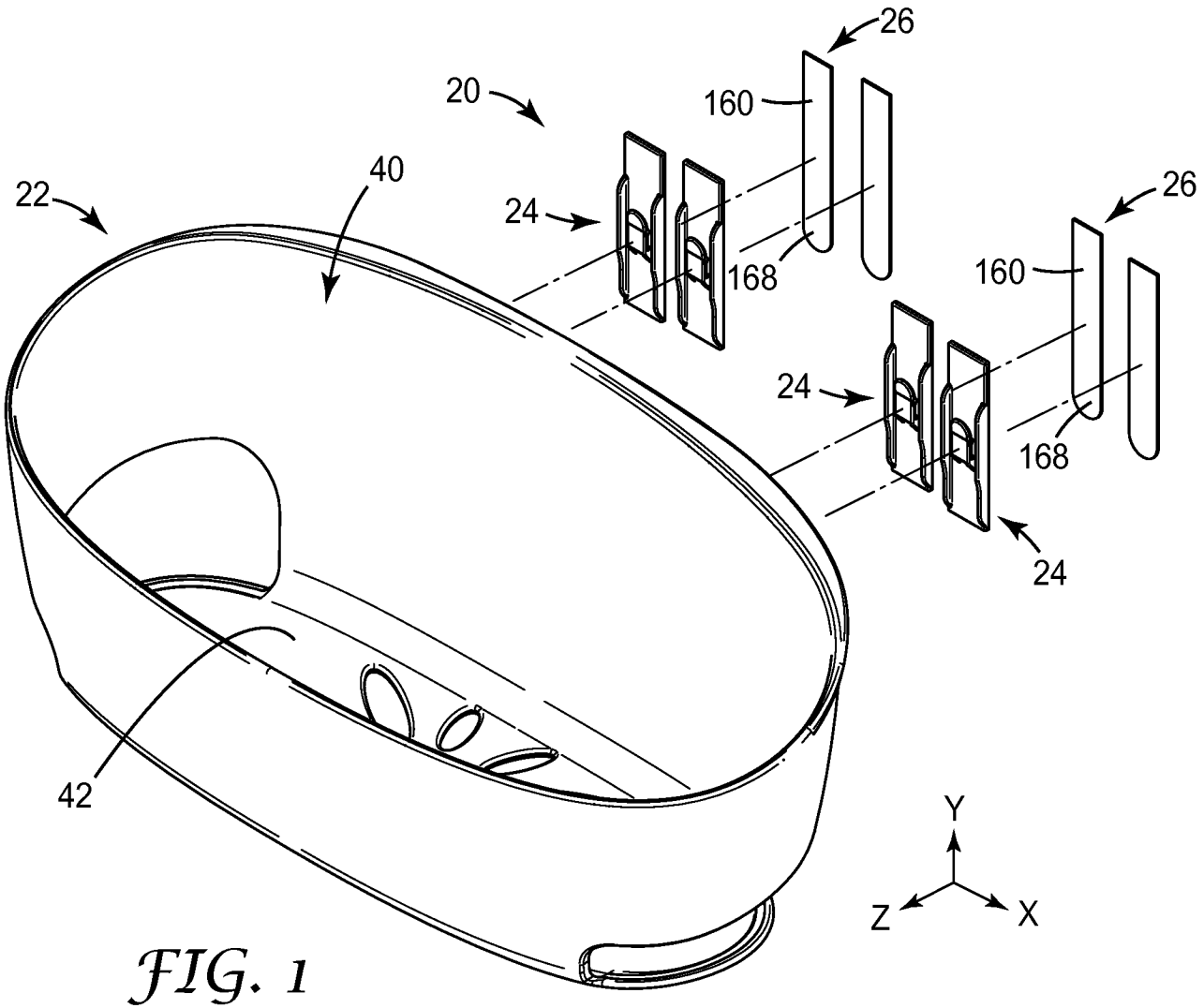
FIG. 1 is a perspective, exploded view of a storage assembly in accordance with principles of the present disclosure.

One embodiment of a storage assembly 20 in accordance with principles of the present disclosure is shown in FIG. 1. The assembly 20 includes a storage device 22, at least one mounting plate 24, and at least one double-faced adhesive 26. Details on the various components are provided below. In general terms, however, the mounting plates 24 couple with corresponding components (i.e., coupling brackets hidden in the view of FIG. 1) of the storage device 22 in a releasable snap fit connection. In this regard, an interface between each of the mounting plates 24 and the corresponding coupling bracket is configured to promote articulation of the mounting plates 24 relative to the storage device 22 while maintaining the snap fit connection. The double-faced adhesives 26 are adhered to corresponding ones of the mounting plates 24, and serve to adhesively bond the assembly 20 to a wall surface.

Figure 2:
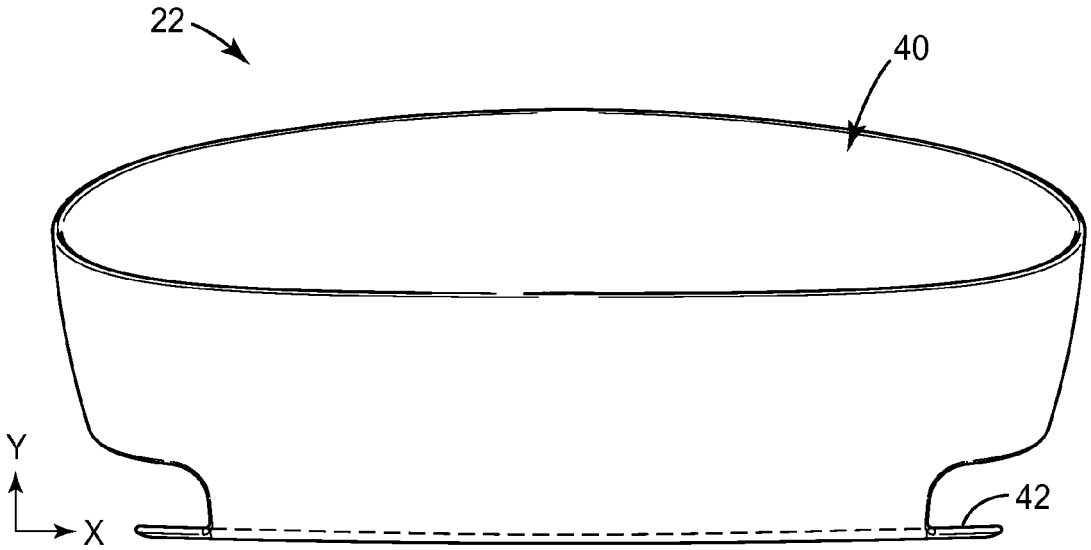
FIG. 2 is a front plan view of a storage device useful with the assembly of FIG. 1.

With additional reference to FIG. 2, the storage device 22 includes a main body or frame 40 configured to provide a desired storage or organizational attribute(s). For example, in the embodiment shown, the main body 40 is a caddy or basket sized and shaped to receive and contain various articles of interest (e.g., shampoo bottle, soap, body wash, etc.). Alternatively, the main body 40 can consist of or include a shelf, a rail or similar structure and/or can provide other storage features of interest (e.g., a holder configured to retain a particular object such as a hand-held razor, etc.). Even further, the main body 40 can provide multiple shelves, multiple caddies, a single caddy with one or more dividers, etc. Alternatively, the storage device main body 40 can include or carry a mirror. Regardless, the main body 40 has an elongated length defined, for example, by a primary shelf or base 42 (e.g., with the construction of FIGS. 1 and 2, where the main body 40 is a caddy, the shelf 42 constitutes a bottom of the caddy). It will be understood that a construction of the primary shelf 42 is not of particular importance to principles of the present disclosure; rather, reference is made to the primary shelf 42 for purposes of designating an intended orientation of the main body 40 during use. A longitudinal (or length) direction defined or generated by a shape of the elongated main body 40 (e.g., by the shelf 42) is designated by the arrow X in FIG. 2, and a transverse (or height) direction perpendicular to the length by the arrow Y. A depth direction (Z) is into the plane of the page of FIG. 2. In some embodiments, the storage device main body 40 is sized and shaped such that the shelf 42 is intended to be arranged in a horizontal orientation upon final mounting of the storage device 22 to a wall. This orientation is reflected in FIG. 2, with the horizontal direction corresponding with the longitudinal direction X. In this same spatial orientation, the vertical direction corresponds with the transverse direction Y. As made clear below, various other features of the storage assembly 20 can be described with respect to the horizontal and vertical (or longitudinal and transverse) directions X, Y established by the intended orientation of the storage device 22. It will be understood, however, that the storage device 22, and in particular the main body 40, can be configured for other spatial orientations in which the primary shelf 42 is not necessarily horizontal. The terms "longitudinal" and "horizontal" are used interchangeably throughout this disclosure, as are the terms "transverse" and "vertical". It should be understood that those terms are used in their relative sense only for ease of explanation and are not limiting. For example, reference to the "horizontal direction" of a feature of a particular object does not limit that object or feature to only being oriented horizontally.

The main body 40 can be made of any desired material or combination of materials. For example, the main body 40 can comprise a generally solid structure (e.g., a molded plastic article) that may have one or more perforations (e.g., for drainage, in the event that the assembly 20 is used as a shower caddy). The main body 40 may encompass any conceivable shape and construction, so long as it may be attached to a wall as described herein. As another example, the main body 40 may comprise a wire-rod structure (e.g., a wire basket).

Figure 3:
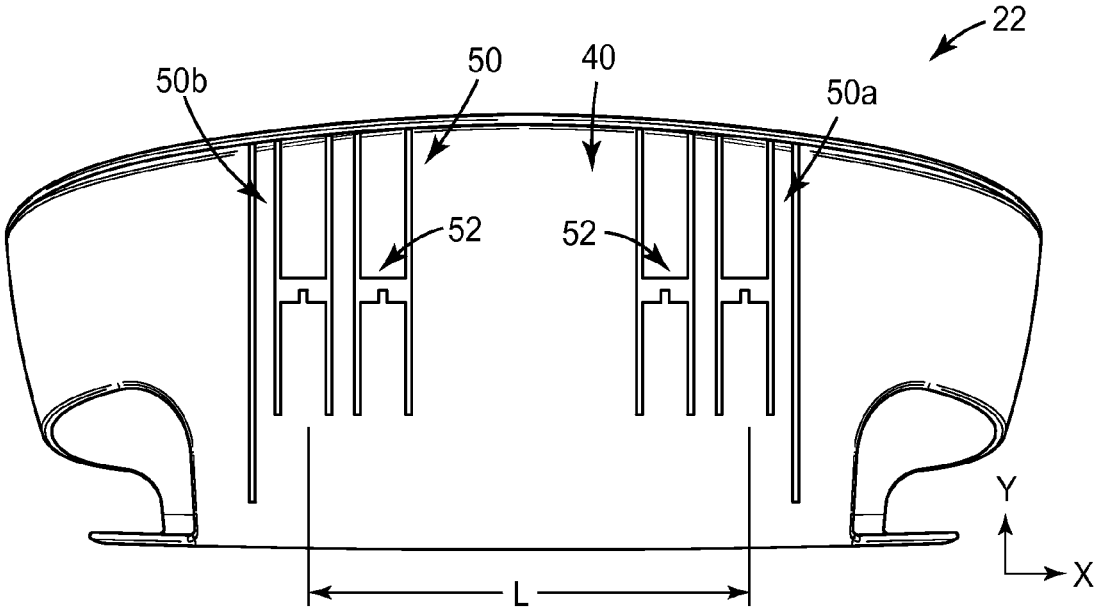
FIG. 3 is a rear plan view of the storage device of FIG. 2.
Figure 4A:
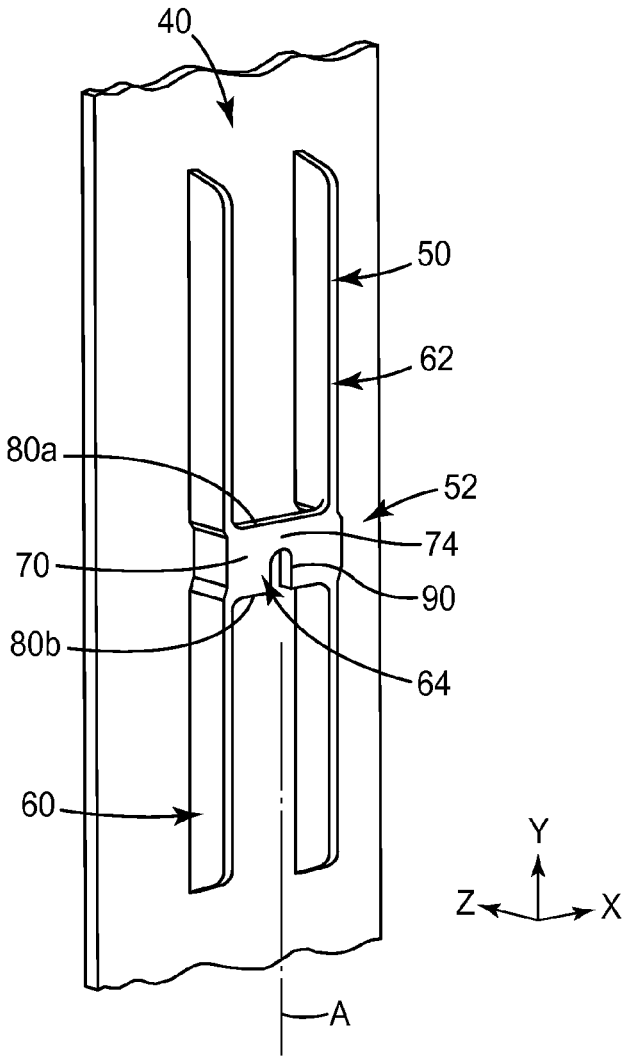
FIG. 4A is an enlarged, perspective view of a portion of the storage device of FIG. 3, illustrating a coupling bracket in accordance with principles of the present disclosure.
Figure 4B:
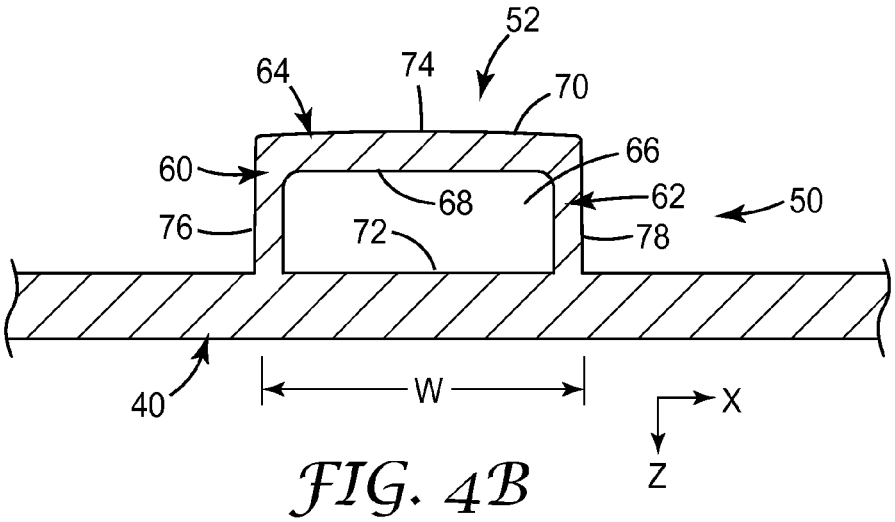
FIG. 4B is an enlarged, cross-sectional view of the coupling bracket of FIG. 4A.

As best shown in FIG. 3, the storage device 22 further includes at least one coupling bracket 50 attached to, or formed by, the main body 40. While four of the coupling brackets 50 are illustrated, in other embodiments a greater or lesser number can be provided. Regardless, the coupling brackets 50 are configured to interface with a corresponding one of the mounting plates 24 (FIG. 1) as described below, and include or provide a first engagement feature 52 (referenced generally). The coupling brackets 50 can be generally identical and is shown in greater detail in FIGS. 4A and 4B. For ease of explanation, only a portion of the main body 40 is shown in FIGS. 4A and 4B and is illustrated in simplified form. In some constructions, the coupling bracket 50 includes first and second legs 60, 62 projecting from the main body 40, and a cross-bar 64 extending between and interconnecting the legs 60, 62. The cross-bar 64 serves as the first engagement feature 52, and is laterally spaced from the main body 40 to establish a gap 66 within which a corresponding component of a respective one of the mounting plates 24*a*, 24*b* is selectively received in a snap fit relationship.

As best shown in FIG. 4B, the cross-bar 64 defines opposing, first and second major surfaces 68, 70. The first major surface 68 "faces" the main body 40 (and thus defines a portion of the confines of the gap 66), and the second major surface 70 is opposite the first major surface 68. As a point of reference, a face 72 of the main body 40 in a region of the coupling bracket 50 can be substantially flat (e.g., a flatness of the face 72 varies by no more than 3% in the vertical direction Y), and each of the legs 60, 62 projects in a substantially perpendicular fashion from the face 72 (i.e., within 2% of a truly perpendicular relationship). The first and second legs 60, 62 can be substantially parallel with one another in extension along the vertical direction Y (shown in FIG. 4A), and the second major surface 70 extends between the legs 60, 62 in the horizontal direction X. With this in mind, the second major surface 70 is not substantially flat in the horizontal direction X, but instead forms a convex curvature in extension between the legs 60, 62. The second major surface 70 can have a constant radius of curvature, forming an apex at a mid-point 74 between the legs 60, 62 (i.e., the second major surface 70 defines a convex curve relative to a plane of the first major surface 68 and/or relative to a plane of the main body face 72 in the horizontal direction X). In some embodiments, the radius of curvature defined by the second major surface 70 in the horizontal direction X is on the order of 2-8 inches. Conversely, the first major surface 68 is substantially flat in the horizontal direction X (e.g., a flatness of the first major surface 68 does not vary by more than 3% in the horizontal direction X between the legs 60, 62). As a point of reference, in some constructions the storage device 22 (FIG. 2) is a homogenous structure, including the main body 40 and the coupling brackets 50 being integrally formed (e.g., the storage device 22 is an injection molded plastic article). With these and other manufacturing techniques, a tolerance range or engineering tolerance is assigned to various dimensional attributes of the finished product and establishes the acceptable limits to deviations from specified physical dimensions engineered into the product design due to manufacturing inconsistencies. The designed flatness of the first major surface 68, for example, can have an engineering tolerance of plus or minus 0.0015 inch. The arcuate or curved shape of the second major surface 70 is well outside of this engineering tolerance range (or other tolerance range associated with the coupling bracket 50*a*) and can include, for example, a difference in "height" (relative to the orientation of FIG. 4B) between the mid-point 74 and the legs 60, 62 of about 0.005-0.015 inch. In other words, the arcuate shape (e.g., convex curve) provided by the second major surface 70 is specifically designed into the coupling bracket 50, and is not the unintended result of manufacturing variations.

As further evidenced by FIG. 4B, the coupling bracket 50 has a width W as defined by the lateral distance between outer edges 76, 78 of the first and second legs 60, 62, respectively. The width W is selected in accordance with features of the mounting plates 24 (FIG. 1) as described below.

Returning to FIG. 4A and with additional reference to FIG. 2, in some embodiments the legs 60, 62 are arranged substantially parallel with one another, and the cross-bar 64 is substantially perpendicular to the legs 60, 62. Further, the coupling bracket 50 is arranged such that the cross-bar 64, in extension between the legs 60, 62, is substantially parallel with a plane of the primary shelf 42. It will be recalled that in some embodiments, the storage device 22 is intended to be arranged during use such that the plane of the primary shelf 42 is substantially horizontal (i.e., arranged in the horizontal direction X). When so arranged, extension of the cross-bar 64 between the legs 60, 62 will also be substantially horizontal, with the curvature of the cross-bar second major surface 70 establishing a cross-bar articulation axis A through the mid-point 74. Upon final mounting to a wall, then, the cross-bar articulation axis A is substantially in the vertical direction Y (i.e., the cross-bar articulation axis A is substantially perpendicular to the plane of the shelf 42 that is otherwise horizontally arranged). Alternatively, the cross-bar articulation axis A can have other relationships relative to the shelf 42 and/or relative to the environment in which the storage device 22 is mounted. However, the cross-bar articulation axis A is substantially aligned with the transverse direction Y in some embodiments.

As made clear below, snap fit engagement of the coupling bracket 50 with a corresponding one of the mounting plates 24 (FIG. 1) is facilitated by a size and shape of the cross-bar 64. In this regard, the cross-bar 64 defines opposing, first and second engagement edges 80*a*, 80*b* that bear against complimentary features of the mounting plate 24 as described below. The engagement edges 80*a*, 80*b* each define a major plane at which the cross-bar 64 interfaces with the mounting plate 24 in snap fitted engagement, and are substantially parallel with one another in some embodiments. Relative to the conventions/directions identified in FIG. 4A, the engagement edges 80*a*, 80*b* (and thus the plane of snap fit interface) are in the horizontal direction X that is substantially perpendicular to the cross-bar articulation axis A.

FIG. 4A illustrates additional, optional features provided with the coupling bracket 50. For example, a notch 90 can be formed in the cross-bar 64 (e.g., at the second engagement edge 80*b*). Where provided, the notch 90 is sized and shaped in accordance with a corresponding component of the mounting plates 24 (FIG. 1) as described below. In some embodiments, the notch 90 is at the mid-point 74. Other mating features can be provided with the cross-bar 64 or at other portions of the coupling bracket 50, and in other embodiments the notch 90 can be omitted.

As shown in FIG. 3, with embodiments in which the storage device 22 includes two (or more) of the coupling brackets 50, the coupling brackets 50 can be aligned in the horizontal direction, and can be grouped in pairs as shown. Other arrangements of a plurality of the coupling brackets 50 relative to one another are also acceptable. With some embodiments, an enlarged longitudinal spacing L is established between outermost ones of the coupling brackets 50*a*, 50*b*. The longitudinal spacing L is a function of an overall length of the storage device 22, and in some constructions is not less than 4 inches, alternatively not less than 5 inches. It will be understood, however, that in other embodiments, the longitudinal spacing L can be less than 4 inches.

Figure 5A:
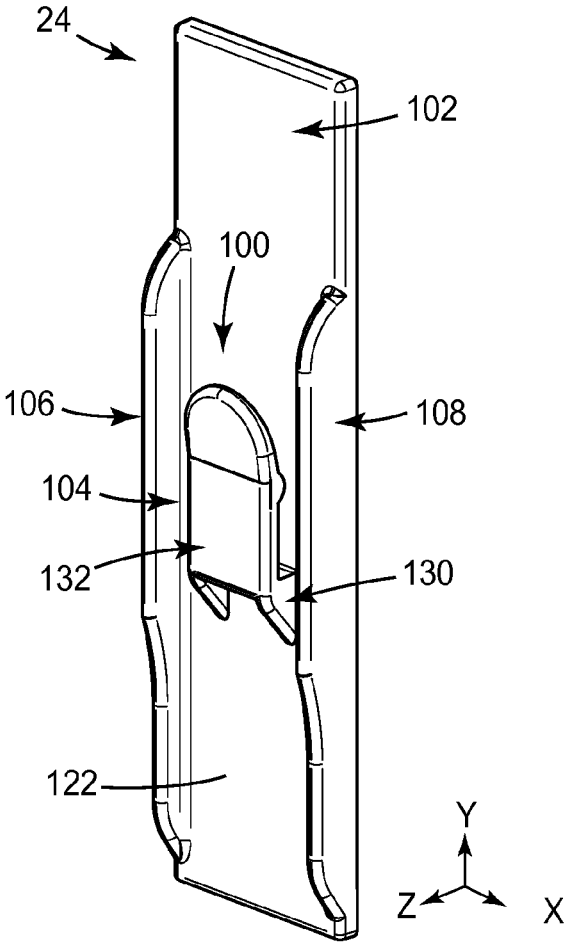
FIG. 5A is a front perspective view of a mounting plate useful with the assembly of FIG. 1.

Returning to FIG. 1, with embodiments in which two or more of the mounting plates 24 are provided, the mounting plates 24 can be identical. One embodiment of the mounting bracket 24 is shown in greater detail in FIGS. 5A-5C, and includes a second engagement feature 100 (referenced generally). In general terms, the second engagement feature 100 corresponds with the coupling bracket first engagement feature 52 (FIG. 3), with the engagement features 52, 100 having a complimentary configuration that facilitates a releasable snap fit connection. To assist in understanding a relationship of the engagement features 52, 100 relative to one another, the X, Y, and Z directions established by the storage device 22 (FIG. 2) as described above are shown in FIGS. 5A-5C commensurate with a spatial arrangement of the mounting plate 24 relative to the storage device 22 upon final assembly to a corresponding one of the coupling brackets 50 (FIG. 3).

The mounting plate 24 includes a base 102, a finger 104, and opposing ribs 106, 108. The finger 104 projects from the base 102 and serves as at least a portion of the second engagement feature 100. The ribs 106, 108 also project from the base 102 apart from the finger 104 for reasons made clear below.

The base 102 is a generally a planar body defining opposing, first and second major faces 120, 122. The first major face (or "bonding face") 120 is substantially flat, and serves as a bonding surface that is configured to receive and be bonded by an adhesive surface provided with one of the double-faced adhesives 26 (FIG. 1). The second major face 122 is also substantially flat in some embodiments, at least in a region of the finger 104.

The finger 104 includes a shoulder 130 and a capture body 132. The shoulder 130 projects outwardly from the second major face 122 in a direction opposite the first major face 120 (e.g., the depth direction Z). The capture body 132 extends in a generally transverse fashion (e.g., the vertical direction Y) from the shoulder 130 in a manner establishing a lateral spacing 134 (e.g., in the depth direction Z) between the capture body 132 and the second major face 122. In this regard, the capture body 132 can be described as defining an interior surface 136 and an exterior surface 138. The interior surface 136 "faces" the base 102, whereas the exterior surface 138 is opposite the base 102. With this in mind, the finger 104 is constructed to provide a biased or spring-like attribute to the capture body 132, whereby the capture body 132 can deflect from the normal arrangement shown (effectively pivoting at the shoulder 130), and self-revert back to the normal arrangement. The capture body 132 includes a first segment 140 extending from the shoulder 130, and a second segment 142 extending from the first segment 140 to a tip 144. The lateral spacing 134 between the interior surface 136 and the second major face 122 of the base 102 tapers along the second segment 142 from the tip 144 to the first segment 140. The lateral spacing 134 along the first segment 140 is relatively uniform. A step 146 is formed as a protrusion from the interior surface 136 at a transition between the first and second segments 140, 142 and represents a further reduction in the lateral spacing 134. More particularly, a capture zone is established between the shoulder 130 and the step 146, and is sized and shaped in accordance with a size and shape of the cross-bar 64 (FIG. 3). The lateral spacing 134 at the step 146 is less than a thickness of the cross-bar 64, and establishes the snap fit connection described below. In this regard, the step 146 and the shoulder 130 combine to define opposing, first and second capture edges 148*a*, 148*b* at which the mounting plate 24 interfaces with the cross-bar 64 in snap fitted engagement. The capture edges 148*a*, 148*b* extend in the horizontal direction X (into the plane of the sheet of FIG. 5C).

Figure 5B:
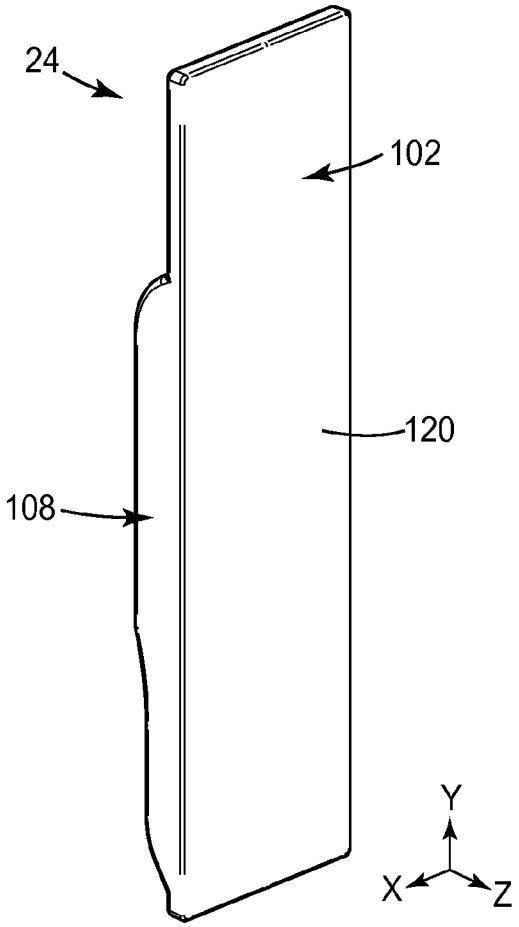
FIG. 5B is a rear perspective view of the mounting plate of FIG. 5A.
Figure 5C:
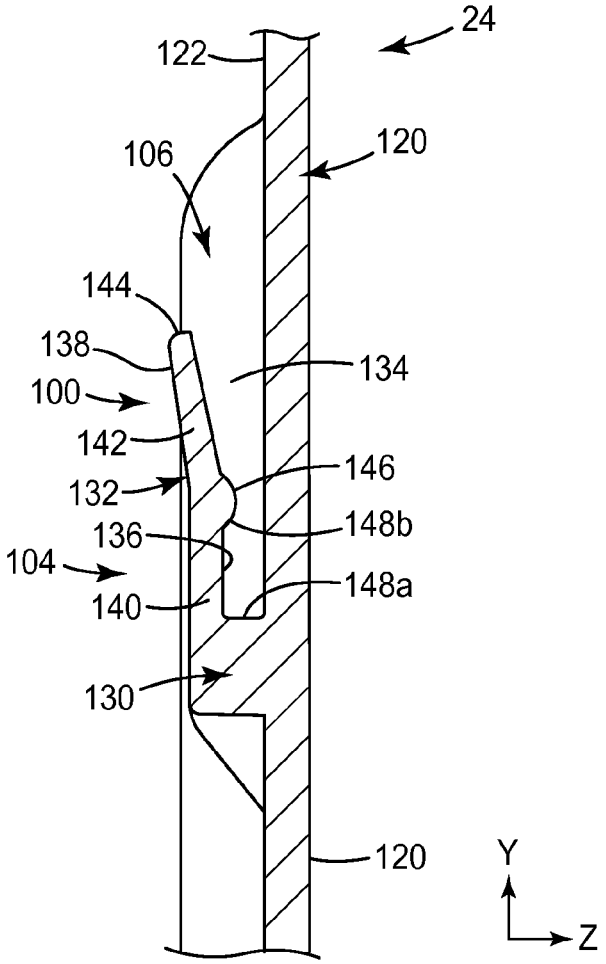
FIG. 5C is a lateral cross-sectional view of the mounting plate of FIG. 5A.
Figure 5D:
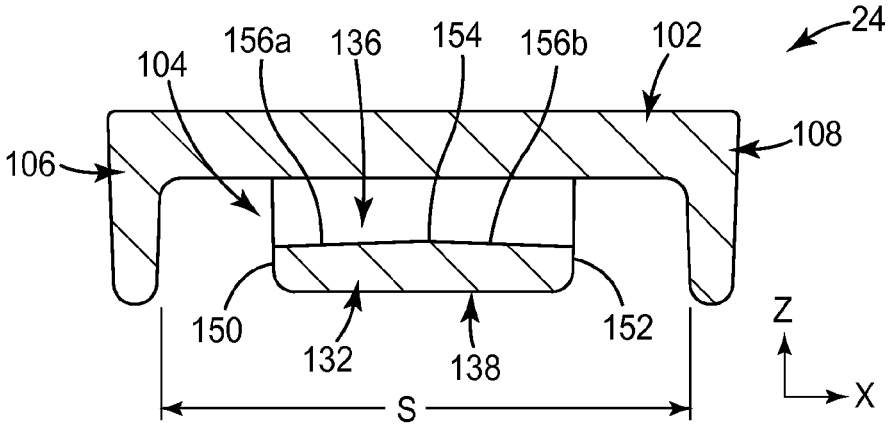
FIG. 5D is a longitudinal cross-sectional view of the mounting plate of FIG. 5A.

As best shown in FIG. 5D, the capture body 132 further defines opposing edges 150, 152. The interior and exterior surfaces 136, 138 extend between the edges 150, 152. In some embodiments, the interior surface 136 along the first segment 140 (FIG. 5C) has a tent-like shape in extension between the opposing edges 150, 152. For example, FIG. 5D reflects the first segment interior surface 136 forming a peak 154, and is recessed at opposite sides of the peak 154 by reliefs 156*a*, 156*b*. The tent-like shape of the interior surface 136 is distinct from allowable or tolerated deviations in flatness due to inherent manufacturing variations. For example, the engineering tolerance for allowable deviations from flatness can be less than 1 degree, whereas the shape of the interior surface 136 represents a 2 degree (or more) relief (relative to the peak 154) from a truly flat arrangement. Thus, the tent-like shape of the interior surface 136 is specifically designed into the finger 104 and is not the unintended result of manufacturing deviations. As made clear below, the tent-like shape of the interior surface 136 facilitates (e.g., does not cause interference with) articulation of the mounting plate 24 relative to the corresponding coupling bracket 50 (FIG. 3) at an interface between the mounting plate second major face 122 and the cross-bar second major surface 70 (FIG. 4B). However, the tent-like shape terminates at or is otherwise not formed along the step 146. State otherwise, the reliefs 156*a*, 156*b* do not extend into the step 146. Thus, the step 146 provides desired surface area for establishing a tight snap fit at the second capture edge 148*b*.

The finger 104 can include other features that promote robust snap fit connection with a corresponding one of the coupling brackets 50 (FIG. 3). For example, the finger 104 can include a detent (not shown) sized and shaped to nest within the notch 90 (FIG. 4A) of the coupling bracket 50. Other components are also envisioned, and in other embodiments the detent can be omitted.

The ribs 106, 108 project from the second major face 122, and are located at opposite sides of the finger 104. As identified in FIG. 5D, a spacing S is defined in the longitudinal direction (i.e., the horizontal direction X) between the ribs 106, 108, and is selected in accordance with the lateral width W (FIG. 4B) of the coupling bracket 50. For example, in some embodiments, the rib spacing S is slightly greater than the coupling bracket lateral width W for reasons made clear below.

Returning to FIG. 1, the double-faced adhesives 26 can be identical and can comprise any suitable sheet, film, layer, etc. that comprises pressure-sensitive adhesive functionality on oppositely-facing surfaces. The double-faced adhesive 26 can be configured such that a first major adhesive surface 160 can be exposed for bonding to the bonding face 120 (FIG. 5B) of a corresponding one of the mounting plates, and such that a second major adhesive surface 162 (hidden in FIG. 1 but shown in FIG. 6A) can be exposed for bonding to the wall to which the storage device 22 is to be mounted.

The double-faced adhesives 26 can be supplied to a user already bonded to the corresponding mounting plate 24; or, the double-faced adhesives 26 can be supplied separately to be bonded to the corresponding mounting plate 24 by the user. The double-faced adhesive 26 can comprise any suitable adhesive that is available in the form of a sheet, tape, roll, etc., from which a discrete piece of adhesive 26 can be obtained that is suitable for being contacted with and bonded to the mounting plate bonding face 120 (FIG. 5B). Suitable adhesives thus include double-stick tapes, laminating adhesives, double-faced foam tapes, and the like, as are commonly known in the art.

In a particular embodiment, the double-faced adhesives 26 each comprise a stretch-release adhesive. Such a stretch-release property can allow the adhesive 26 to be securely attached to a surface and to be later removed from the surface without visual disfigurement of, or leaving adhesive residue on, the surface.

A suitable stretch-releasing adhesive can comprise an elastic backing, or a highly extensible and substantially inelastic backing, with a pressure-sensitive adhesive disposed (e.g., coated) thereupon. Or the stretch-releasing adhesive can be formed of a solid, elastic pressure-sensitive adhesive. Thus, in this context, the term "stretch-releasing adhesive" encompasses products that comprise a unitary, integral, or solid construction of adhesive (in addition to products that comprise a backing with separate layers of adhesive residing thereupon). Suitable exemplary stretch-releasing adhesives are described in U.S. Pat. No. 4,024,312 to Korpman; German Patent No. 33 31 016; U.S. Pat. No. 5,516,581 to Kreckel et al.; and PCT International Publication No. WO 95/06691 to Bries et al., the teachings of each of which are incorporated herein by reference. Such stretch-release adhesives can range, for example, from about 0.2 mm in thickness to about 2 mm in thickness. If the storage assembly 20 is to be mounted in a moist environment (e.g., if the storage device 22 is a shower caddy), the composition of the stretch-releasing adhesive can be chosen so as to maintain appropriate adhesion in the presence of moisture.

If the double-faced adhesive piece 26 is a stretch-releasing adhesive, it can comprise a pull tab 168 portion (e.g., an end of the adhesive piece 26 that does not comprise adhesive), which may be grasped by a user and pulled so as to activate the stretch-release properties of the adhesive when it is desired to detach the assembly 20 from a wall. A suitable stretch-releasing adhesive is the double-sided stretch removable adhesive strips available from 3M Company, St. Paul, Minn. under the COMMAND trade designation. Commercially available COMMAND adhesive strips are currently manufactured as discrete strips with one end of the strip including a non-adhesive pull tab to facilitate stretching of the strip during removal.

A single piece or strip of the double-faced adhesive 26 can be attached to the bonding face 120 (FIG. 5B) of the corresponding mounting plate 24; or, multiple ones of the pieces 26 can be used with a single one of the mounting plates 24. For example, if the bonding face 120 is approximately 1⅝ inches wide, two pieces of the double-faced adhesive 26, each approximately ¾ inch wide, can be bonded side-by-side on the bonding face 120. If two (or more) pieces of adhesive are used, the pieces may be bonded so as to not be in contact with one another.

Figure 6A:
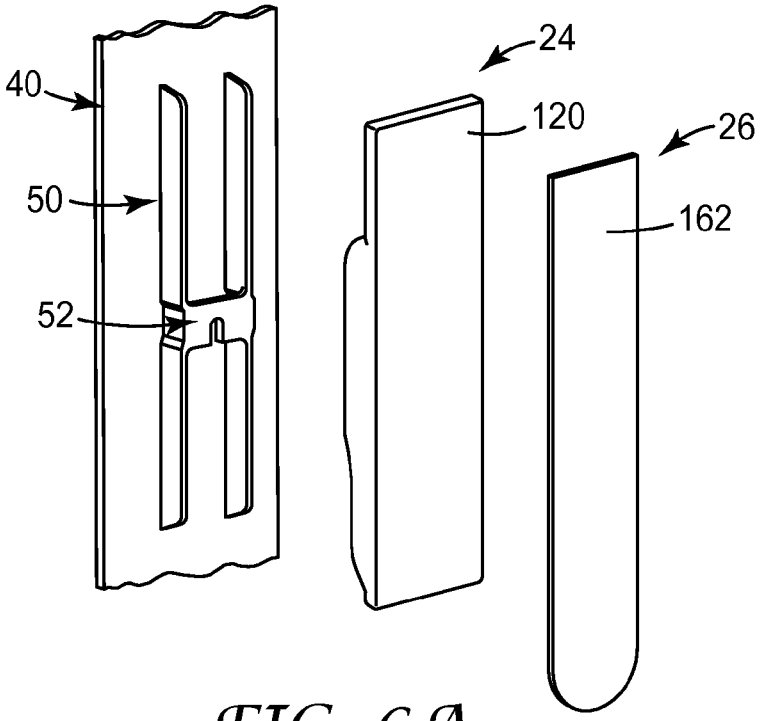
FIG. 6A is a rear perspective view of a portion of the assembly of FIG. 1, illustrating a relationship of a coupling bracket, mounting plate, and double-faced adhesive.
Figure 6B:
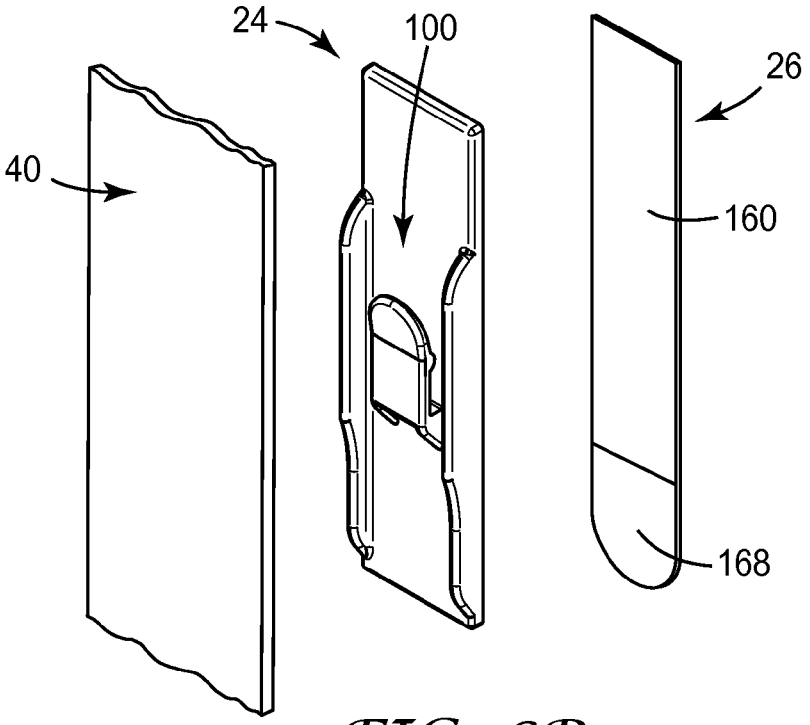
FIG. 6B is a front perspective view of the arrangement of FIG. 6A.
Figure 7A:
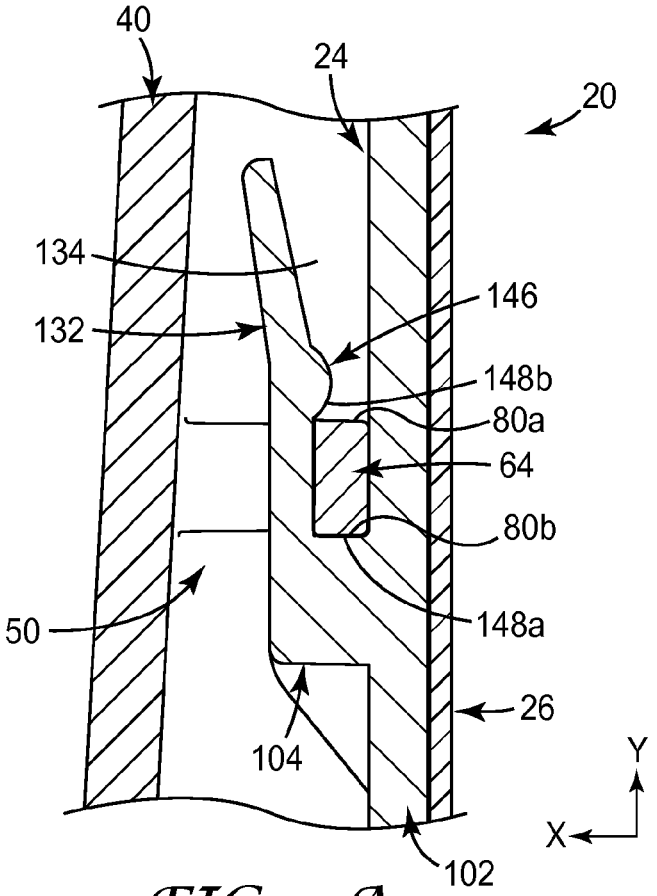
FIG. 7A is a longitudinal cross-sectional view of the arrangement of FIG. 6A upon final assembly.

FIGS. 6A and 6B illustrate a relationship between one of the coupling brackets 50, one of the mounting plates 24, and one of the double-faced adhesives 26. As described above, the coupling bracket 50 is formed by or provided with the organizer main body 40; for ease of illustration, a portion of the main body 40 is shown in simplified form in FIGS. 6A and 6B. With this in mind, the double-faced adhesive 26 is arranged such that the first major adhesive surface 160 faces and is exposed to the bonding face 120 of the mounting plate 24. The mounting plate 24 is further arranged relative to the coupling bracket 50 such that the first and second engagement features 52, 100 can be assembled to one another in a releasable snap fit connection. For example, and with additional reference to FIG. 7A, the mounting plate 24 is secured to the coupling bracket 50 by sliding the capture body 132 of the finger 104 between the cross-bar 64 and the main body 40. As reflected in the view, a thickness of the cross-bar 64 is less than the transverse spacing 134 between the step 146 and the base 102 such that as the cross-bar 64 comes into contact with the step 146, the capture body 132 is caused to deflect away from the base 102. With further movement of the cross-bar 64 toward the shoulder 130, the capture body 132 self-reverts back to the arrangement shown, thereby capturing the cross-bar 64 between the finger 104 and the base 102. A rigid snap fit connection is effectuated between the cross-bar 64 and the finger 104 by robust contact/engagement of the cross-bar engagement edges 80*a*, 80*b* with the corresponding finger capture edges 148*a*, 148*b*, respectively. In some embodiments, the snap fit connection is configured to be maintained under loads (e.g., a load in the vertical direction Y) of at least 2 lbs, optionally loads up to 10 lbs.

Figure 7B:
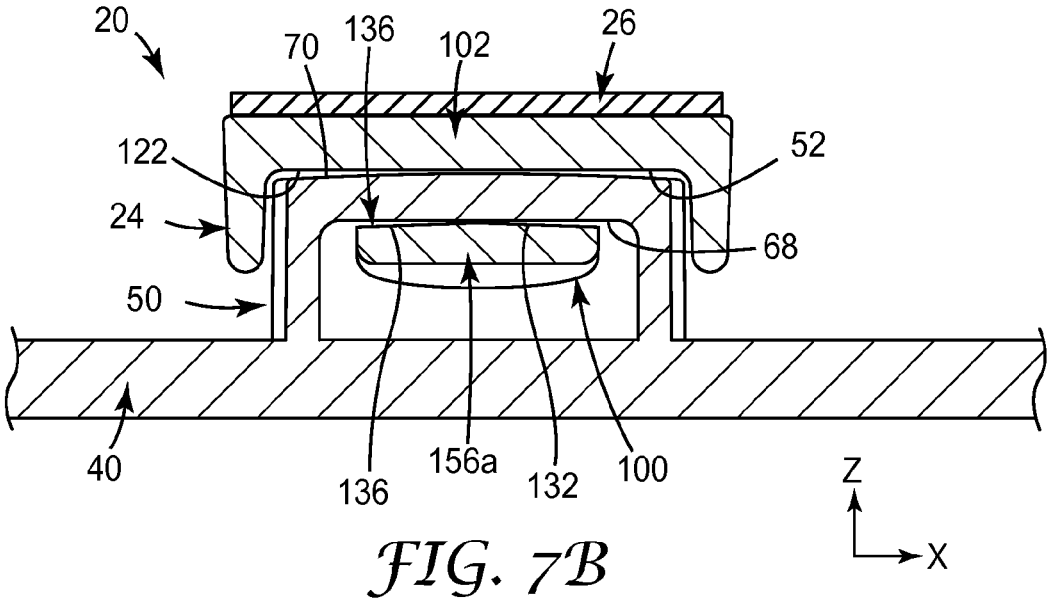
FIG. 7B is a lateral cross-sectional view of the assembly of FIG. 7A.
Figure 7C:
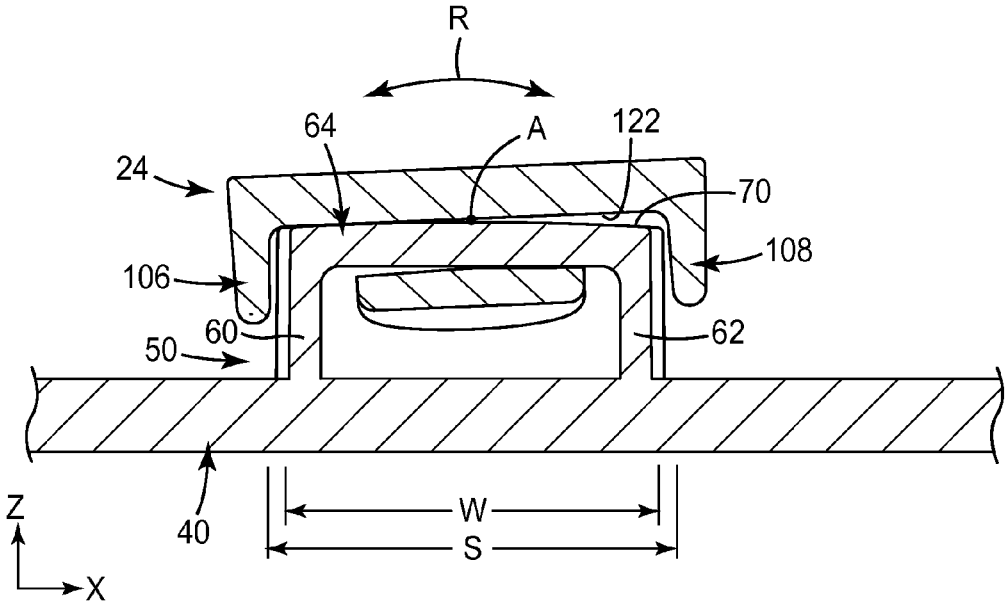
FIG. 7C is a simplified end view of the arrangement of FIG. 7B and illustrating articulation of the mounting plate relative to the coupling bracket.

As further shown in FIG. 7B, in the snap fit connection arrangement, the second major face 122 of the mounting plate 24*a* abuts against the second major surface 70 of the cross-bar 64, whereas the interior surface 136 of the capture body 132 abuts against the first major surface 68 of the cross-bar 64. Due to the arcuate or convexly curved shape of the cross-bar second surface 70 and the substantial flatness of the second major face 122, the second major face 122 can articulate, slide, pivot or rock relative to the cross-bar 64 (and vice-versa) while the rigid snap fit connection is at all time maintained. An interface between the cross-bar first major surface 68 and the finger interior surface 136 does not overtly interfere with this desired articulation. In particular, the reliefs 156*a*, 156*b* along the interior surface 136 provide clearance for the capture body 132 relative to the cross-bar 64 as the mounting plate 24 articulates relative to the coupling bracket 50. As shown by the arrow R in FIG. 7C, then, the mounting plate 24 can articulate (e.g., pivot and/or rock) relative to the coupling bracket 50 (and thus relative to the main body 40), and vice-versa. In some embodiments, the mounting plate 24 can pivot relative to the coupling bracket 50 over a range of 1°-5° while retaining the snap fit connection. As a point of reference, the cross-bar articulation axis A is identified in FIG. 7C. Because the component interface does permit possible sliding of the mounting plate second major face 122 relative to the cross-bar second major surface 70, the final snap fit connection does not rigidly maintain contact of the mounting plate second major face 122 at the cross-bar articulation axis A, nor does the mounting plate 24 pivot relative to the coupling bracket 50 only about the cross-bar articulation axis A. Instead, a more rolling-like interface is established, with the mounting plate 24 capable of "pivoting" relative to the cross-bar 64 at an effectively infinite number of points along the cross-bar second major surface 70. The articulating relationship can more generally be described as including pivoting about an axis that is parallel with the cross-bar articulation axis A and thus in the vertical direction Y (i.e., into the plane of the page of FIG. 7C) as the mounting plate second major face 122 "rolls" or articulates along the cross-bar second major surface 70.

With embodiments in which the coupling bracket 50 includes the legs 60, 62 and the mounting plate 24 includes the ribs 106, 108, the width W defined by the legs 60, 62 is less than the spacing S between the ribs 106, 108, thereby providing sufficient clearance for articulation, pivoting or rotation of the mounting plate 24 relative to the coupling bracket 50 (and vice-versa).

Figure 8:
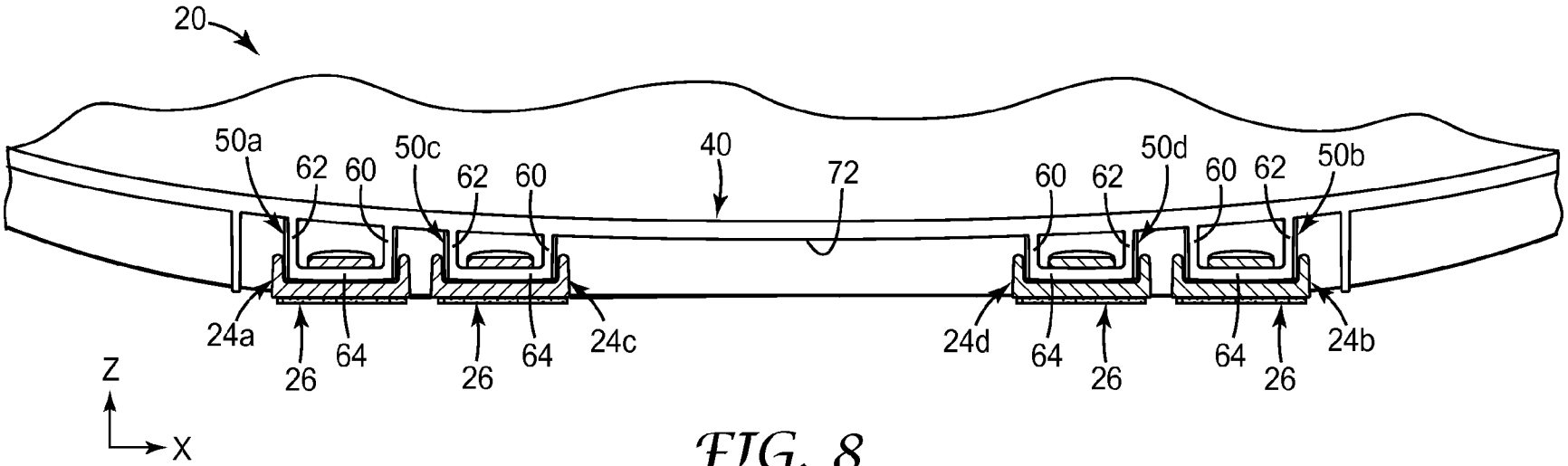
FIG. 8 is a lateral cross-sectional view of a portion of assembly of FIG. 1 upon final construction.

FIG. 8 illustrates a portion of one embodiment of the storage assembly 20 upon final assembly of each of the mounting plates 24/double-faced adhesives 26 to respective ones of the coupling brackets 50. With this one exemplary embodiment, four of the coupling brackets 50*a*-50*d* are provided, along with four of the mounting plates 24*a*-24*d*. As shown, the outer face 72 of the storage device main body 40 can have a curvature in the horizontal or longitudinal direction X; under these circumstances, the coupling brackets 50*a*-50*d* may not be identical to accommodate the curved face 72 (e.g., the legs 60, 62 of each of the coupling brackets 50*a*-50*d* can have differing dimensions in the depth direction Z, and the legs 60, 62 of the outer coupling brackets 50*a*, 50*b* can be larger (in the depth direction Z) than the legs 60, 62 of the inner coupling brackets 50*c*, 50*d*). Other configurations of the coupling brackets 50 relative to one another are also acceptable. However, with embodiments including two or more of the coupling brackets 50, the corresponding cross-bars 64 can be arranged to be co-planar as shown.

Figure 9:
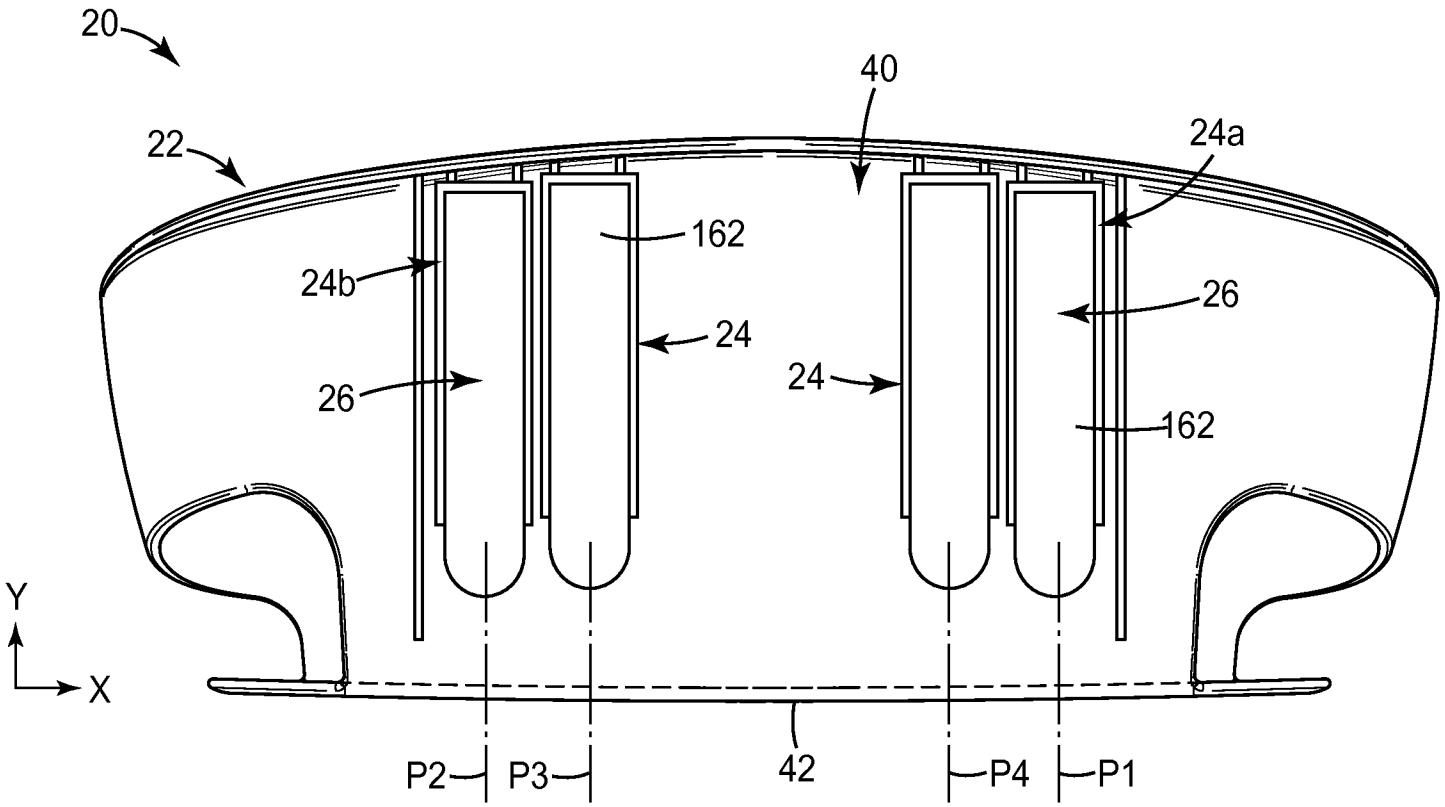
FIG. 9 is a rear plan view of the assembly of FIG. 1 upon final construction.

The articulating attributes provided by storage assemblies of the present disclosure are further illustrated in the view of FIG. 9. As shown, the mounting plates 24 have been secured to corresponding ones of the coupling brackets 50 (generally hidden in the view of FIG. 9, but shown in FIG. 3). The snap fit interface between the mounting plate 24 and the corresponding coupling bracket is such that the mounting plate 24 can articulate (slide, pivot and/or rock) about an articulation axis due to the engagement features described above (it being recalled that due to the above described rolling-type interface between the first and second engagement features 52, 100 (FIGS. 7B and 7C), a singular pivot axis of the mounting plate 24 relative to the cross-bar 64 (FIG. 7C) does not exist; however, incremental "pivoting" will occur about an axis that is aligned with the articulation axis indentified in FIG. 9. For example, FIG. 9 identifies a first articulation axis P1 established for the first mounting plate 24*a*, and a second articulation axis P2 established for the second mounting plate 24*b*. With the one exemplary embodiment providing four of the mounting plates 24 (and four of the coupling brackets 50), FIG. 9 identifies corresponding third and fourth articulation axes at P3 and P4. In some embodiments, two or more of all of the articulation axes P1-P4 are substantially parallel to one another (i.e., within 5 percent of a truly parallel relationship). Further, with some end use arrangements, the storage device 22 is arranged such that the shelf 42 is spatially horizontal. Under these circumstances, two or more or all of the articulation axes P1-P4 are substantially vertical (i.e., extend in the transverse or vertical direction Y). Of course, the storage assembly 20 can be spatially arranged in other orientations that may or may not locate one or more of the articulation axes P1-P4 in the vertical direction Y. In some embodiments, however, each of the articulation axes P1-P4 are substantially parallel to the major plane of the shelf 42. Moreover, the snap fit engagement/interface as described above is in the horizontal direction X (to support resist a load in the vertical direction Y), and the articulation axes P1-P4 are substantially perpendicular to the snap fit engagement direction (i.e., in the vertical direction Y).

In some embodiments, installation of the storage assembly 20 includes attaching the mounting plates 24 to respective ones of the coupling brackets 50 (FIG. 1) as described above (i.e., snap fit connection), and bonding at least one of the double-faced adhesives 26 to a corresponding one of the mounting plates 24. The second adhesive surface 162 of the double-faced adhesives 26 is then exposed, and the storage assembly 20 maneuvered toward the wall to which the storage assembly 20 is to be secured, with the exposed adhesive 162 facing the wall. Under circumstances where the wall in question is substantially flat, the double-faced adhesive 26 can be thoroughly bonded to the wall by simply pressing the main body 40 toward the wall. In some installation environments, however, the wall may not be substantially flat. For example, in some instances (e.g., a bath or shower enclosure), the wall can have a slight curvature and/or have surfaces that are not perfectly aligned (e.g., a tiled surface). Under these circumstances, as the main body 40 is pressed toward the wall, the mounting plates 24 can or will articulate relative to the corresponding coupling bracket 50 so that the exposed adhesive surface 162 of the double-faced adhesive 26 associated with each of the mounting plates 24 becomes substantially aligned with the contacted region of the wall surface and maximize wet out of the adhesive.

Figure 10A:
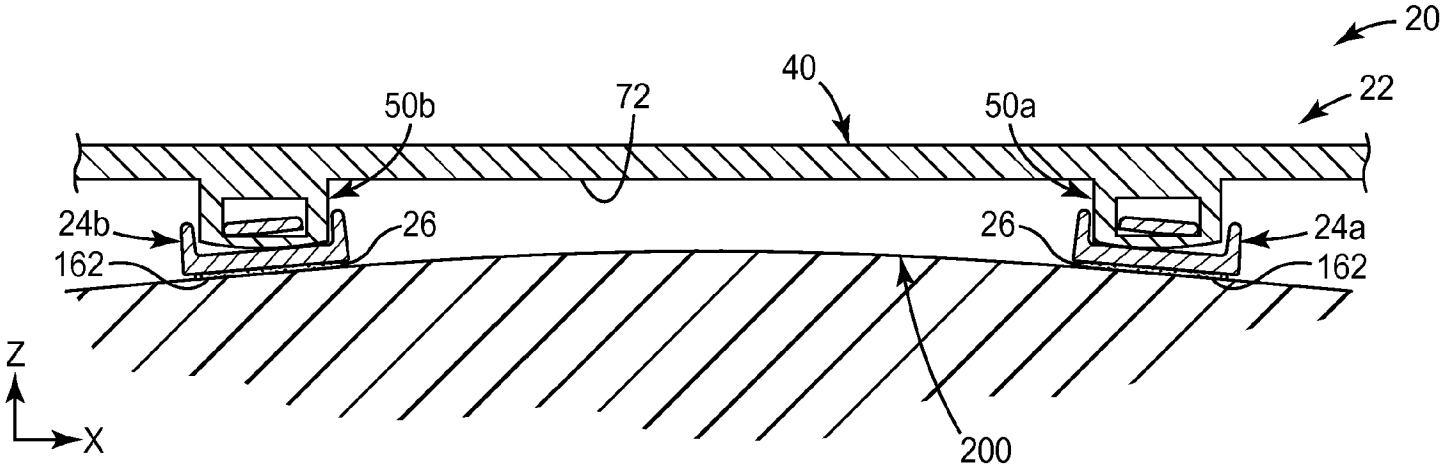
FIG. 10A is a simplified cross-sectional view illustrating mounting of the assembly of FIG. 1 to a wall surface.
Figure 10B:
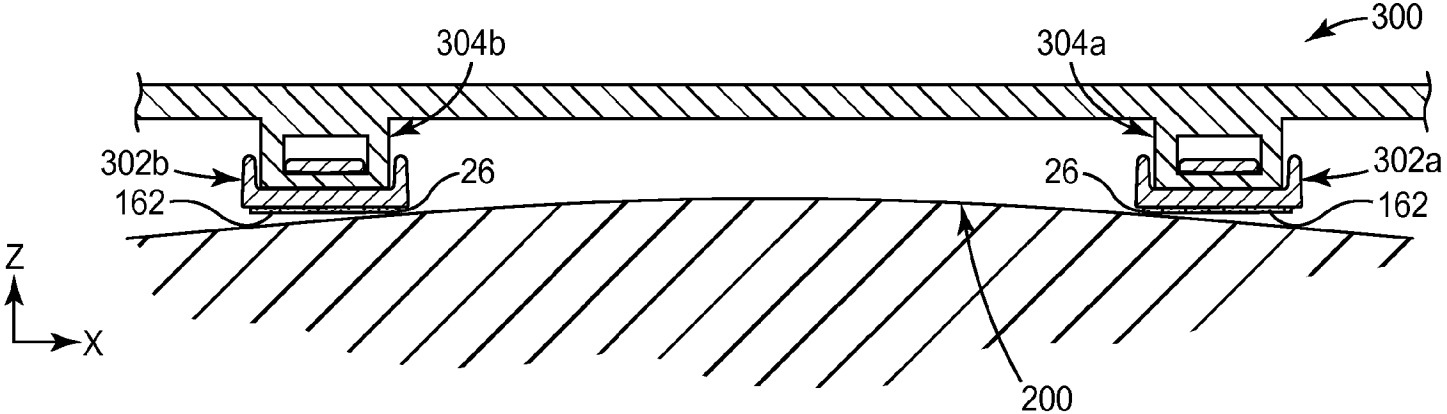
FIG. 10B is a simplified cross-sectional view illustrating attempted mounting of a storage device assembly not in accordance with the present disclosure to the wall surface of FIG. 10A.

By way of comparison, FIG. 10A illustrates desired articulation of the mounting plates 24 in securing the storage device 22 to a less-than-flat wall surface 200 (in at least the horizontal direction X shown) while retaining the snap fit connection. For ease of explanation, the storage assembly 20 is shown in simplified form, including the outer face 72 of the main body 40 being relatively flat, and having two of the coupling brackets 50*a*, 50*b* and a corresponding two of the mounting plates 24*a*, 24*b*. The mounting plates 24*a*, 24*b* have each articulated relative to the corresponding coupling bracket 50*a*, 50*b* so as to permit the corresponding adhesive surface 162 to come into complete contact with the wall surface 200. The articulation attributes are equally beneficial with other non-flat installation environments (e.g., a shower enclosure wall forming a concave curve). Conversely, FIG. 10B illustrates an attempt to secure a storage device 300 to the wall surface 200 under circumstances where the mounting plates 302*a*, 302*b* are rigidly attached to the corresponding coupling brackets 304*a*, 304*b*. As shown, because the mounting plates 302*a*, 302*b* cannot rotate or articulate relative to the coupling brackets 304*a*, 304*b*, the adhesive surface 162 of the double-faced adhesives 26 do not come into complete contact with the wall surface 200. This undesirable situation may be more prevalent where the double-faced adhesives 26*a* are thin (e.g., film-based or adhesive only).

The wall mountable storage assemblies of the present disclosure, and related methods of installation, present a marked improvement over previous designs. The first and second engagement features provided with the storage assemblies of the present disclosure afford a desired releasable snap fit between the corresponding components, yet facilitate articulation or rotation of the mounting plates relative to the storage device. This relationship, in turn, better ensures proper contact of the double-faced adhesives with the wall surface to which the storage device is being secured.

Although the present disclosure has been described with reference to preferred embodiments, workers skilled in the art will recognize that changes can be made in form and detail without departing from the spirit and scope of the present disclosure. For example, while the coupling brackets have been described as including a first engagement feature in the form of a cross-bar and the mounting plates as providing a second engagement feature in the form of a finger, these constructions can be reversed (e.g., the coupling brackets can include the finger described above, whereas the mounting plates provide the cross-bar).

What is claimed is:

1. A wall mountable storage assembly comprising:

a storage device including:

a main body, at least one coupling bracket attached to the main body, the coupling bracket forming a first engagement feature;

at least one mounting plate forming a bonding face and a second engagement feature, wherein the bonding face is adapted to receive a double-faced adhesive, and further wherein the second engagement feature is formed opposite the bonding face;

wherein the first and second engagement features have a complimentary construction configured to provide a releasable snap fit connection of the mounting plate with the coupling bracket, and further wherein the snap fit connection includes the mounting plate being articulatable relative to the coupling bracket;

a first double-faced adhesive configured to be arranged between the bonding face and a wall for securing the storage assembly to the wall; and wherein one of the first and second engagement features includes a cross-bar defining opposing first and second major surfaces, and another of the first and second engagement features includes a finger extending from a base, and further wherein the snap fit connection includes the cross-bar captured between the finger and the base.

2. The storage assembly of claim 1, wherein the main body includes a primary shelf for supporting auxiliary articles, the shelf defining a major plane, and further wherein the snap fit connection includes the mounting plate being articulatable relative to the coupling bracket about a pivot axis that is perpendicular to the major plane.

3. The storage assembly of claim 2, wherein the storage assembly is configured to be mounted to the wall such that the major plane is arranged horizontally and the pivot axis is arranged vertically.

4. The storage assembly of claim 1, where the main body is selected from the group consisting of a caddy and a shelf.

5. The storage assembly of claim 1, wherein:

the at least one coupling bracket includes first and second coupling brackets attached to the main body in a spaced-apart fashion, each of the first and second coupling brackets including the first engagement feature;

the at least one mounting plate includes first and second mounting plates each including the second engagement feature; and the storage assembly further includes a second double-faced adhesive;

wherein securing of the storage assembly to the wall includes the first mounting plate attached to the first coupling bracket in a snap fit connection, the second mounting plate attached to the second coupling bracket in a snap fit connection, the first double-faced adhesive between the first mounting plate and the wall, and the second double-faced adhesive between the second mounting plate and the wall.

6. The storage assembly of claim 1, wherein the snap fit connection includes the base bearing against the first major surface and the finger bearing against the second major surface.

7. The storage assembly of claim 6, wherein the first major surface forms a convex curve to promote articulation of the base about the first major surface.

8. The storage assembly of claim 7, wherein the base forms a major face that contacts the first major surface in the snap fit connection, and further wherein the major face is substantially flat.

9. The storage assembly of claim 6, wherein the finger includes a capture body defining an interior surface, the interior surface forming a peak and opposing reliefs to promote articulation of the finger relative to the second surface.

10. The storage assembly of claim 9, wherein the interior surface abuts the second major surface in the snap fit connection, and further wherein the second major surface is substantially flat.

11. The storage assembly of claim 6, wherein the coupling bracket further includes opposing legs projecting from the main body at opposite sides of the first engagement feature, and further wherein the mounting plate further includes opposing ribs extending at opposite sides of the second engagement feature, and even further wherein a lateral spacing between the opposing legs is less than a lateral spacing between the opposing ribs to promote articulation of the mounting plate relative to the coupling bracket.

12. The storage assembly of claim 6, wherein the first engagement feature is provided with the coupling bracket and the second engagement feature is provided with the mounting plate.

13. The storage assembly of claim 6, wherein the first engagement feature is provided with the mounting plate, and the second engagement feature is provided with the coupling bracket.

14. The storage assembly of claim 1, wherein the first double-faced adhesive comprises a stretch-releasing adhesive strip.

15. The storage assembly of claim 1, wherein the mounting plate defines a long axis, and further wherein the snap fit connection includes the mounting plate being articulatable relative to the coupling bracket about an axis that is parallel with the long axis.

16. The storage assembly of claim 1, wherein the snap fit connection includes the mounting plate being articulatable relative to the coupling bracket over a range of 1-5 degrees.

17. A wall mountable storage assembly comprising:

a storage device including:

a main body, first and second coupling brackets attached to the main body in a longitudinally spaced-apart fashion, wherein each of the first and second coupling brackets forms a first engagement feature;

first and second mounting plates each forming a bonding face and a second engagement feature, wherein the bonding face is adapted to receive a double-faced adhesive, and further wherein the second engagement feature is formed opposite the bonding face;

wherein the first and second engagement features have a complimentary construction configured to provide a releasable snap fit between one of the mounting plates and a corresponding one of the coupling brackets;

wherein one of the first and second engagement features includes a cross-bar defining opposing first and second major surfaces, and an other of the first and second engagement features includes a finger extending from a base such that the snap fit connection includes the cross-bar captured between the finger and the base;

wherein the first major surface forms a convex curve against which the base bears, and the finger forms a contact surface having a convex curve that bears against the second major surface such that the snap fit connection includes the mounting plate being articulatable relative to the corresponding coupling bracket; and first and second double-faced adhesives configured to be arranged between the bonding face of a corresponding one of the mounting plates and a wall for securing the storage assembly to the wall.

18. The storage assembly of claim 17, wherein the main body includes a primary shelf for supporting auxiliary articles, the primary shelf defining a major plane, and further wherein the snap fit connection includes each of the mounting plates being articulatable relative to the corresponding coupling bracket about an articulation axis that is perpendicular to the major plane.

19. A method of mounting a storage device to a wall, the method comprising:

receiving a storage device including:

a main body, first and second coupling brackets attached to the main body and each including a first engagement feature, wherein the first coupling bracket is longitudinally spaced from the second coupling bracket;

snap fitting a second engagement feature of a first and a second mounting plate to the first engagement feature of the coupling brackets, respectively, wherein one of the first and second engagement features includes a cross-bar defining opposing first and second major surfaces, and another of the first and second engagement features includes a finger extending from a base, and further wherein snap fitting involves capturing the cross-bar between the finger and the base, exposing an adhesive surface of a double-faced adhesive carried by each of the mounting plates;

moving the storage device toward the wall such that the exposed adhesive surfaces initially contact the wall; and articulating at least one of the mounting plates relative to the main body, including the mounting plates remaining in the snap fit connection to the corresponding coupling bracket, such that the exposed adhesive surfaces fully contact and bond to the wall.

* * * * *